US006352637B1

(12) United States Patent
Doolin et al.

(10) Patent No.: US 6,352,637 B1
(45) Date of Patent: Mar. 5, 2002

(54) HIGH COKING VALUE PITCH

(75) Inventors: Patricia K. Doolin, Ashland, KY (US); Melvin D. Kiser, Huntington, WV (US); Robert H. Wombles, Gibsonia, PA (US)

(73) Assignee: Marathon Ashland Petroleum, LLC, Findlay, OH (US)

( * ) Notice: Subject to any disclaimer, the term of this patent is extended or adjusted under 35 U.S.C. 154(b) by 0 days.

(21) Appl. No.: 09/467,327

(22) Filed: Dec. 20, 1999

Related U.S. Application Data

(60) Provisional application No. 60/114,524, filed on Dec. 31, 1998.

(51) Int. Cl.[7] ..... C10C 1/04; C10C 3/06

(52) U.S. Cl. ..... 208/41; 208/42; 208/22; 208/23

(58) Field of Search ..... 208/42, 41, 22, 208/23

(56) References Cited

U.S. PATENT DOCUMENTS

| | | | | | |
|---|---|---|---|---|---|
| 4,066,159 | A | | 1/1978 | Romovacek | |
| 4,222,916 | A | | 9/1980 | Hergenrother | |
| 4,264,371 | A | * | 4/1981 | Dell | 106/284 |
| 4,504,455 | A | * | 3/1985 | Otami et al. | 432/447.6 |
| 4,537,635 | A | | 8/1985 | Bart et al. | |
| 5,262,043 | A | | 11/1993 | Boenigk et al. | |
| 5,746,906 | A | | 5/1998 | McHenry et al. | |

* cited by examiner

*Primary Examiner*—Walter D. Griffin
*Assistant Examiner*—Tam M. Nguyen
(74) *Attorney, Agent, or Firm*—Richard D. Stone

(57) ABSTRACT

A high coking value pitch with a relatively low softening point is disclosed. A pitch is distilled or thermally processed to produce an intermediate pitch with an increased coking value and relatively high softening point, then blended with a cutter solvent of a liquid hydrocarbon stream to form a product pitch. The process may be used to increase the coking value of either petroleum or coal tar pitch. Preferably the cutter solvent is methylnaphthalene, or a highly aromatic, low viscosity oil or similar aromatic rich stream having a substantially lower boiling point than the intermediate pitch product.

5 Claims, 3 Drawing Sheets

HIGH COKING VALUE PITCH

CROSS REFERENCE TO RELATED APPLICATIONS

This application claims the benefit under 35 U.S.C. 120 of prior co-pending, provisional application No. 60/114,524, filed on Dec. 31, 1998.

BACKGROUND OF THE INVENTION

I. Field of the Invention

The invention relates to a pitch with a high coking value.

II. Description of the Prior Art

There are two basic types of pitch—coal tar based and petroleum based. These materials have many uses. Pitches with a low softening point, on the order of 40° C., are blended with water and clay to seal driveways and/or blended with other materials to seal metal surfaces, e.g., pipe coatings. Petroleum pitches with a 240° F. softening point are used as binder pitch for clay pigeons and for graphite electrodes for steel manufacturing. Coal tar pitch with a softening point of about 110° C. is used for making anodes for aluminum smelting and electric arc furnaces. There are some petroleum pitches (softening points of 250–500° F.) which are used to make carbon fibers. Some manufacturers use a special low sulfur A240 pitch to produce their mesophase carbon fibers.

For some of these applications, coking value is not significant. Driveway sealers are not heated to form coke. For some applications, usually those involving the high softening point pitches, coking value and softening point are critical.

As an example of the criticality of coking value, coal tar pitch is widely used in the aluminum industry, but petroleum pitch is not. The primary reason is that coal tar pitch has a significantly higher coking value than a petroleum pitch with a like softening point.

It is possible to change the softening point of any pitch by distilling it, but the coking value/softening point relationship is hard to change for a given feedstock, i.e., coal or petroleum. Many pitch refiners consider the coking value/softening point curve to be fixed.

It is relatively simple, using distillation techniques (conventional or wiped film evaporator), to produce a high coking value pitch, but the softening point goes up in a predictable fashion. It is also possible to blend coal tar pitch and petroleum pitch and achieve roughly additive effects, i.e., the coking value is about what would be expected from blending two different kinds of pitch together. Blending up to 10–15 wt % of one type of pitch in the other is a common practice to "extend" the more costly pitch, which is usually the coal tar pitch.

U.S. Pat. No. 5,746,906, McHenry, et. al., May 5, 1998, disclosed a coal tar pitch/petroleum pitch blend and method of making it. A crude coal tar material is selected according to specific properties including QI, specific gravity, water and ash content. A petroleum pitch material is also selected according to its softening point, QI, coking value and sulfur content. The coal tar pitch is distilled to an uncharacteristically high softening point then mixed with a lower softening point petroleum pitch to a desired softening end point. The material retains significant QI and coking value characteristics of pure coal tar pitch particularly for use in Soderberg-type anodes for aluminum smelting as well as electric arc furnace electrodes. PAH emissions, and more specifically B(a)P equivalent emissions, are all reduced by approximately 40%. The examples disclose blending a petroleum pitch with a softening point of 80° C. nominal with coal tar pitch having a softening point of 137.5° C. (Example 1) and 138.1 to 147.8° C. (Example 2). This patent describes a binary mixture of coal tar pitch and a petroleum pitch having a softening point of ≈80° C.

For completeness, fractionation and use of cutter stock for pitch production will be briefly reviewed.

Control of coal tar pitch fractionation is described in U.S. Pat. No. 4,066,159.

Control of petroleum pitch fractionation is straightforward distillation.

Blends of, e.g., a petroleum pitch with cutter stock have been made either to adjust the properties of slightly off spec products or to simplify the production of low softening point pitches. A240 pitch can be cut back with #6 fuel oil to yield pitch specialty products having a low softening point. Some physical properties of various commercial petroleum pitch products are summarized in the following section.

TABLE 1

Specifications and Typical Properties of Marathon Ashland Petroleum Pitch CAS Number 68334-31-6

| Analysis | Test Method | A170 Pitch | A240 Pitch | A225 Pitch |
|---|---|---|---|---|
| Specification Points | | Limits | | |
| Softening Point, Mettler ° C. | ASTM D3104 | 79.4–82.6 | 118–124 | 105–110 |
| Softening Point, Ring & Ball ° F. | ASTM D36 | 166–171 | 235–248 | 212–221 |
| Flash, Cleveland Open Cup, ° C. minimum | ASTM D92 | 200 | 270 | 260 |
| Coking Value, Modified Conradson Carbon, wt %, minimum | ASTM D2416 | NA | 49 | 46 |
| Sulfur Content, wt %, maximum | ASTM D1552 or D4294 | NA | 3.0 | 1.5 |
| Typical Properties | | Values | | |
| Specific Gravity, Helium Pycnometer, g/cc, minimum | ASTM D71 | 1.18 | 1.22 | 1.22 |
| Moisture, wt %, maximum | — | — | 0.5 | — |
| Toluene Insolubles, wt %, minimum | ASTM D4072 | — | 2.10 | 2.10 |
| Quinoline Insolubles, wt % maximum | ASTM D 2318 | 0 | 0.5 | 0.5 |

In addition to these high softening point materials, blends of A240 and #6 fuel oil have been made to produce specialty products ranging from thick liquids to materials having a softening point of 110° C. In addition to direct production of A225 from the unit, A225 may be made by blending A240 pitch with either A170 or slurry oil.

"A 500" pitch is a viscous liquid, a blend of 35% A240 pitch and 65% #6 fuel oil. The product has a viscosity specification of 230–300 centipoise at 160° F.

"A 120" pitch is a blend of 37% A240 pitch and 63% fuel oil. The semi-solid blend has a softening point of about 111° F.

HIGH SOFTENING POINT PITCH

Extensive work has been done towards developing special procedures to produce high softening point pitch.

Conoco reports that oxidation of certain mesophase precursors led to a material that could, with heat soaking, be converted into a mesophase material. This is reported in U.S. Pat. No. 4,892,642, Romine, et al., issued Jan. 9, 1990, Process for the Production of Mesophase, and U.S. Pat. No. 4,892,641, Fuet, et al., issued Jan. 9, 1990, Process for the Production of Mesophase Pitch. In each patent, a carbonaceous feedstock substantially free of mesophase pitch is heated at elevated temperatures in the presence of an oxidatively reactive sparging gas. Subsequent heat soaking and heat treatment of the oxidized isotropic carbonaceous feed is reported to have resulted in substantial quantities of mesophase.

In a paper entitled Air-Blowing Reactions of Coal Tar Pitch 1. Properties of Pitch Modified By Air-Blowing (T. Maeda, et al. *Ext. Abst. Nineteenth Biennial Conference on Carbon*, University Park, Pa., p. 180 (1989)), researchers of Osaka Gas Company Limited report air-blowing of petroleum derived carbonaceous materials to result in isotropic pitches being produced. Air-blowing was reported as a recognized procedure to raise the softening point temperature and coking value of petroleum derived carbonaceous materials. Hence, the procedure is asserted to be applicable and desirable for producing precursor pitch for isotropic general purpose carbon fibers.

U.S. Pat. No. 4,999,099, Ta Wei Fu and Manfred Katz, discloses a process for heating a carbonaceous feedstock at mesophase-forming temperatures while simultaneously passing a sparging gas containing an oxidative component selected from the group consisting of $O_2$, $O_3$, $H_2O_2$, formic acid vapor, and/or hydrochloric acid vapor with an inert gas component to produce a mesophase pitch that is reported to be especially suitable for the manufacture of carbon fibers. The process involves partial oxidation and partial removal of volatile components as a result of the sparging gas.

U.S. Pat. No. 4,209,500, Chwastiak, issued Jun. 24, 1980, discloses a process for making high mesophase content pitch in which carbonaceous feed is heated with agitation and a passing of an inert gas through the pitch.

U.S. Pat. No. 3,976,729 and U.S. Pat. No. 4,017,327, both issued to Lewis, et al., involve agitating a carbonaceous starting material while heat treating same. In DE No. 2221707 and DE No. 2357477, patent applications of Koppers Company, Inc., the manufacture of isotropic carbon fibers is disclosed. The starting material for carbon fibers is first oxidized with oxygen and then vacuum distilled to remove non-oxidized lower boiling components.

ART SUMMARY

This voluminous art could be summarized as follows. Any pitch can be made to have any softening point desired, within limits by conventional heat and distillation treatments. Coal tar pitch and petroleum pitch have similar responses to heat and distillation, but coal tar always has a higher coking value than petroleum pitch for the same softening point. Blends of coal tar pitch and petroleum pitch can be made to give a product with intermediate results. It is not possible using currently available technology to improve the coking value of either coal tar pitch or petroleum pitch, at least not while keeping the softening point constant.

We discovered a way to break free from this constraint and increase the coking value of pitch while keeping the softening point constant. We could also keep the coking value constant while reducing the softening point to improve the workability of the material.

BRIEF SUMMARY OF THE INVENTION

A processed pitch having an increased coking value relative to Mettler softening point prepared by distilling or thermally processing an initial pitch having an initial coking value above 50 wt % and an initial softening point to produce a high coking value and high softening point pitch having a coking value of at least 55 wt % and at 10% higher than said initial coking value and an increased softening point, and softening said high coking value pitch with a liquid hydrocarbon cutter oil to produce a processed pitch having an increased coking value relative to said initial coking value.

In another embodiment, the present invention provides a method of making a pitch having a coking value below 60 wt % comprising distilling or thermally processing a pitch or pitch precursor to produce a high coking value pitch having a coking value above 60 wt % and reducing the coking value of said high coking value pitch by blending with a cut-back solvent; a method of making a pitch having a coking value above 55 wt % and a softening point below 130° C. comprising distilling or thermally processing a pitch or pitch precursor to produce a high coking value pitch having a coking value of 60 wt % to 80 wt % and a softening point above 130° C. and reducing the coking value and softening point of said high coking value pitch by blending with an aromatic cut-back solvent to produce a pitch having a coking value above 55 wt % and a softening point below 130° C.; a method of improving the coking value of an oxidized petroleum pitch having an initial coking value of from 35 wt % to 45 wt % and an initial softening point comprising distilling or thermally processing said pitch to produce a processed pitch having an increased coking value and increased softening point and softening said processed pitch with a cutter solvent to produce a product pitch having an increased coking value relative to said initial pitch; a method of producing a pitch product having a target coking value above 50 wt % and a target softening point comprising:

distilling or thermally processing a pitch or pitch precursor to produce an initial pitch product having a coking value above 50 wt %, a softening point above 240° F., and above said target softening point, an initial boiling point and a 10% boiling point;

selecting a cutter solvent having a 90% boiling point and an end boiling point and wherein there is a gap between at least one of said 90% boiling point and said end point of said solvent and at least one of said initial boiling point and said 10% boiling point of said pitch;

blending a sufficient amount of said cutter solvent with said initial pitch product to reduce the softening point thereof and produce a product pitch having a coking value of at least 50 wt %, is a method of improving the coking value of an oxidized petroleum pitch having an initial coking value of from 35 wt % to 45 wt % and an initial softening point comprising distilling or thermally processing said pitch to produce a processed pitch having an increased coking value and increased softening point and softening said processed pitch with a cutter solvent to produce a product pitch having an increased coking value relative to said initial pitch.

DETAILED DESCRIPTION

Figure 1:
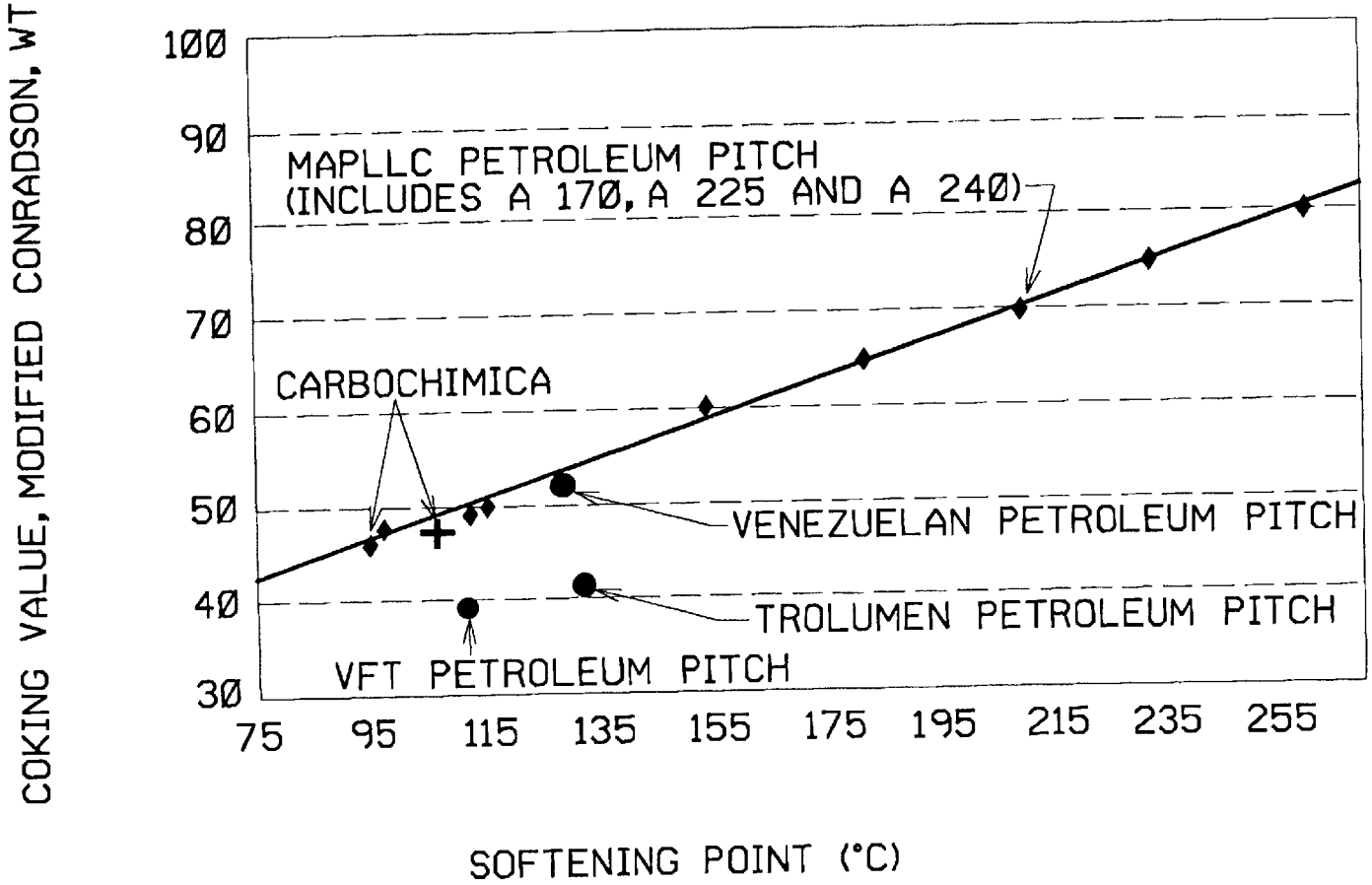
FIGURE 1 (PRIOR ART)
FIG. 1 prior art) is a graph of coking values v. softening point for petroleum pitch.

For clarity, and to avoid the confusing terminology used in many patents, several terms will be defined. This "definition" section is intended as an overview, with detailed specification for each material provided later.

Coal tar pitch is the product of thermal or destructive distillation of coal. "Petroleum pitch" is a residue from heat treatment and distillation of petroleum fractions. It is a solid at room temperature, consists of a complex mixture of numerous predominantly aromatic and alkyl-substituted aromatic hydrocarbons, and exhibits a broad softening point range instead of a defined melting point. Coal tar pitch is a residue produced by distillation or heat treatment of coal tar. It is also solid at room temperature, consists of a complex mixture of numerous predominantly aromatic hydrocarbons and heterocyclics, and exhibits a broad softening point range. "Ref. Introduction to Carbon Technologies", Editors H. Marsh, E. A. Heintz, F. Rodriquez-Reinoso, Secretariado de Pulbicaciones, 1997. Wood tar pitch has been made for millennia by "cooking" pine oil or the liquid recovered during charcoal manufacture. All these materials, whether derived from coal tar, petroleum or wood, are "pitch" for the purposes of the present invention.

Petroleum pitch can be a suitable starting material for use herein. A240 pitch from Marathon Ashland Petroleum LLC is an excellent starting material, but will require further distillation or thermal processing to produce a material with an increased softening point and a higher coking value. Trolumen and VFT pitch are commercially available petroleum pitches which are generally not preferred starting materials because the coking value/softening point relationship is inferior to that of the A240 pitch. These inferior pitches may be significantly improved by the process of the present invention, but are not preferred.

Coal tar pitch can be a suitable starting material and such products are available from a variety of US and foreign manufacturers.

Cut-back oil is a normally liquid hydrocarbon stream which is compatible with the high softening point pitch. There are many normally liquid hydrocarbon streams in a refinery, ranging from naphtha fractions to heavy liquids, which are only distillable under a vacuum, e.g., vacuum gas oil. The most preferred cut-back oil is a highly aromatic oil having low viscosity and sulfur with a high flash point and boiling point between 500 and 600° F. Preferred streams are aromatic extract from lube plants (though a high sulfur content, i.e., 5%, reduces the value of the final product), cycle oil and slurry oil from FCC columns, and coker gas oils. Heavy fuel, a complex blend of heavy liquid refinery products, is not preferred because the quality and characteristics of the heavy fuel oils are so variable. Other streams which can be used include light streams obtained during the distillation of the pitch product. A low sulfur cut-back oil, with less than 5 wt % S, preferably less than 2 wt % S, or 1 wt % S or even less, is preferred. "Gap" refers to a difference in boiling points between the initial boiling point of a pitch fraction and the end boiling-point-of the cut-back-oil. Preferably, any cut-back oil used will have a gap relative to the boiling point characteristics of the pitch. As applied to petroleum pitch, it is our intent to exclude use of a cut-back oil produced by taking a liquid draw a few trays above the pitch or bottom draw on the fractionator. As applied to coal tar pitch, we would not use a creosote fraction withdrawn a few trays above the pitch draw off point. Although these materials are ideal from a miscibility standpoint, they are not effective for changing the coking value softening point relationship.

Softening point means Mettler Softening Point using the ASTM D3104 test method, which is incorporated by reference. Samples of petroleum pitch products are loaded into specially designed sample cups, placed into the Mettler Softening Point apparatus, and heated at 2° C./min (3.6° F./min) until a sample viscosity equivalent to 10,000 poise is reached. This equivalence is established by movement of the sample (flow) over a set distance.

A low softening point facilitates processing and/or blending of the pitch. If the pitch is a semi-solid and too thick to use as, e.g., an impregnant, it cannot be used for that purpose.

Coking value means ASTM D2416 Coking Value, which is incorporated by reference. Somewhat oversimplified, it measures the weight percent coke which would remain after severe heat treatment (900° C.) in a standardized manner using a specialized laboratory furnace assembly which converts the pitch to a solid and drives off all remaining volatiles. A 3 g pitch sample, which after the specified heat treatment leaves 1.5 g of coke in the sample container, has a coking value of 50. High coking value is beneficial in an impregnant in that each treatment with pitch leaves more coke behind. High coking value is important in binder pitch, applications because there is less shrinkage of the anode during calcination. High coking value is essential in carbon fiber processing where pitch goes from a liquid phase directly to a solid fiber.

In our process, the pitch is first processed to make a pitch with an unacceptable softening point and a coking value higher than that needed in the final product. This material could be called "peak pitch" and could be compared to life in the high country. Peaks are difficult to get to and you may not want to stay there. The peak pitch is then mixed or blended with a controlled amount of a carefully selected cutter solvent or cut-back oil to make a plateau pitch with an acceptable softening point and satisfactory coking value. This plateau pitch will have a higher coking value than a pitch made from the same starting material which had not been through the peak pitch treatment.

PITCH

In general, any pitch (petroleum, coal tar or wood) will benefit from peak processing and solvent softening.

In general, it is beneficial to start with materials which have a good softening point/coking value relationship and further improve these. In this sense, coal tar pitch would be preferred because it has an excellent coking value. Many operators will prefer to start with petroleum pitch, even though it does not have as high a coking value as coal tar pitch, because petroleum pitch has lower levels of carcinogens and bad smelling compounds and/or because of price. It is also possible to use this processing technique to greatly improve the coking value of pitches which are considered inferior materials, thus an oxidized petroleum based pitch with a low coking value can be improved by pitch peak processing and softening to produce a product which has coking value.

Starting coal tar pitches, when desired, may be made using the method and apparatus of U.S. Pat. No. 4,066,159, Method and Apparatus for the Control of Pitch Still Operation. An oxidized coal tar distillation cut may also be used as disclosed in U.S. Pat. No. 4,537,635. These patents are incorporated by reference.

Starting petroleum pitches may be bought from Marathon Ashland Petroleum LLC (A240 is an excellent starting material) or Carbochirnica SPA PPC 90 or PPC 110, or PDVSA, or Laporte (VFT).

Preferred starting point petroleum pitches will have a coking value above 50 wt %. An excellent starting material is A240 pitch, the physical properties of which are disclosed in Table I of U.S. Pat. No. 5,429,739, which is incorporated by reference. These properties are also documented in Table I of this document.

Peak processing, to produce a pitch with an unacceptably high softening point and increased coking value relative to the starting point pitch, can be done with conventional distillation/thermal processing techniques used to make high softening point coal tar pitches or using Wiped Film Evaporators (WFE), as disclosed in U.S. Pat. No. 5,429,739. Conventional flash still techniques can generate pitch with softening points up to 400° F. and coking values up to 70 wt %. The short residence time offered by use of a WFE is required to go to softening point of 500° F. and 80 wt % coking values without product degradation. In addition to WFE processing, other conventional techniques for obtaining high coking value, high softening point pitches may be used, though not necessarily with similar results. These prior art pitch processes were summarized under the discussion of High Softening Point Pitch in the DESCRIPTION OF THE PRIOR ART.

PEAK PITCH

As applied to petroleum pitch materials, the peak pitch preferably has a coking value of at least 55 wt %, and more preferably at least 60 wt %. Excellent results are obtained with high coking value pitches, such as those with a 70 wt % coking value and 80 wt % coking value. Even higher coking value pitches can beneficially be processed using our technique, but with present day technology it is difficult to make petroleum pitch with much higher than an 80 wt % coking value and to make this material requires careful processing in a WFE.

CUT-BACK OIL

Softening point solvent or cutter stock or cut-back oil is an essential ingredient for blending with the high coking value peak pitch. There are a variety of refinery liquid hydrocarbon streams which can be used, though not necessarily with the same results. These include:

FCC heavy cycle oil

FCC heavy naphtha

FCC slurry oil, or clarified slurry oil

Gas oil

Vacuum Gas Oil

Coker naphtha

Coker gas oil

#6 Fuel oil (a mix of low value refinery streams)

The softening point solvent is preferably fairly aromatic (to promote miscibility with the peak pitch), not so light in boiling point range as to cause flash point problems, but not so heavy as to have any significant overlapping boiling range with the peak pitch. Thus use of # 6 fuel oil is not preferred because the material is too variable and too heavy. Use of FCC slurry oil is not preferred because the material is too close in boiling range to the peak pitch.

Especially preferred are lighter refinery streams, such as those disclosed in Table II in the EXAMPLES SECTION.

EXAMPLES:

Example 1 (Prior Art) Petroleum Pitch

Example 1 and FIG. 1 (Prior Art) is a collection of coking values v. softening point for petroleum pitch.

Example 2 (Prior Art) Coal Tar Pitch

Figure 2:
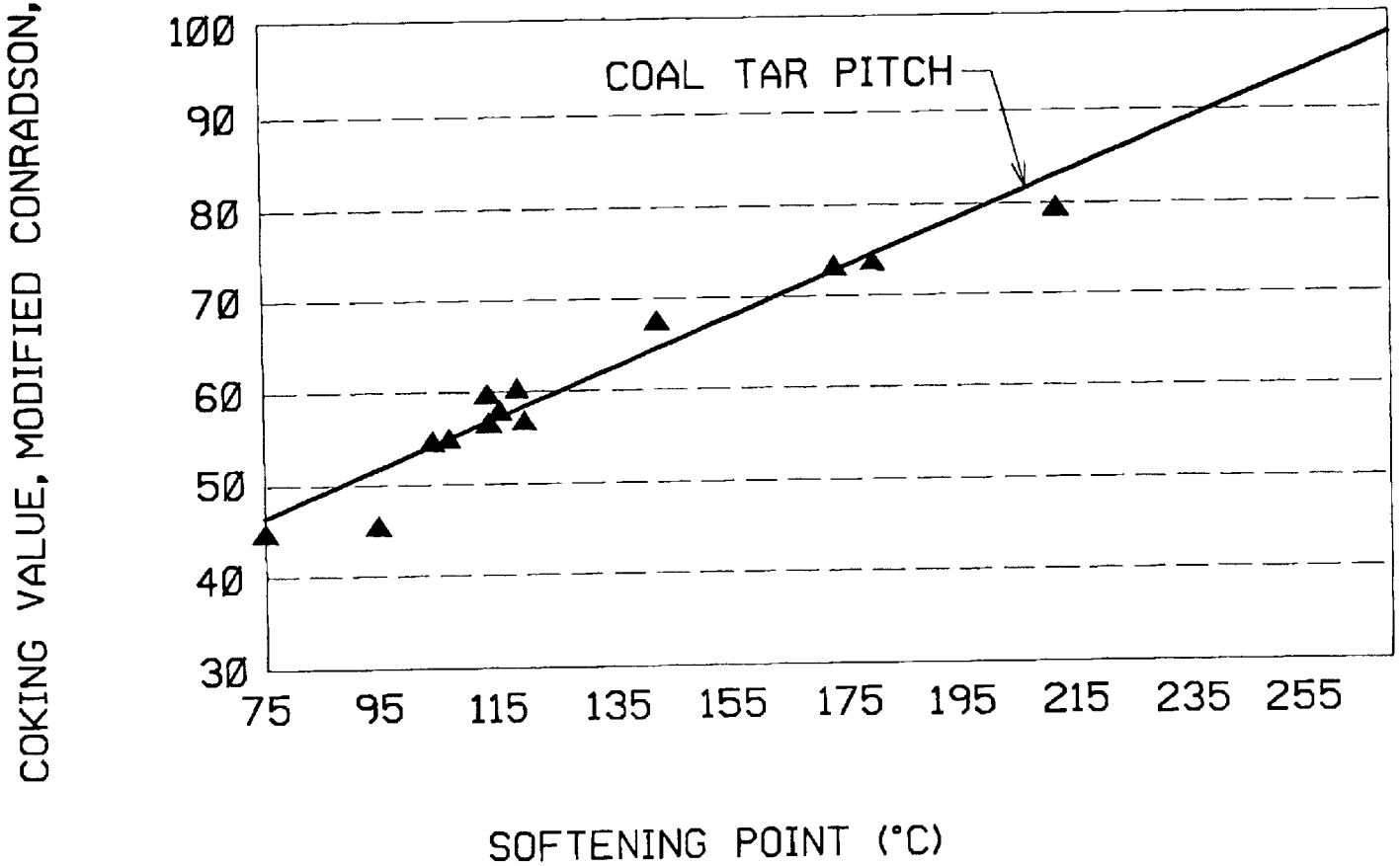
FIGURE 2 (PRIOR ART)
FIG. 2 (prior art) is a graph of coking values v. softening point for coal tar pitch.

Example 2 and FIG. 2 (Prior Art) is a collection of coking values v. softening point for coal tar pitch. The curve is similar to that for petroleum pitch but at every point the coking value of coal tar pitch is significantly higher than the coking value of petroleum pitch. The slopes are similar, but the coal tar pitch always has a higher coking value.

The Example 1 and Example 2 information are well known and all acceptable pitch products produced today can fit on one or the other of these graphs. The VFT and Trolumen petroleum pitch do not fall on the petroleum curve but these petroleum pitches are considered inferior to A240 from Marathon Ashland Petroleum LLC.

Blends of the two types of pitch (coal tar and petroleum) will produce a blended pitch with properties roughly equal to what would be expected from linear extrapolation.

We wanted to devise a way to break free from the constraints of the curves shown in FIG. 1 and FIG. 2. The key was "peak" processing to produce a high softening point, high coking value pitch and solvent softening with a solvent which was significantly lighter than the pitch.

Example 3 (Invention)

Figure 3:
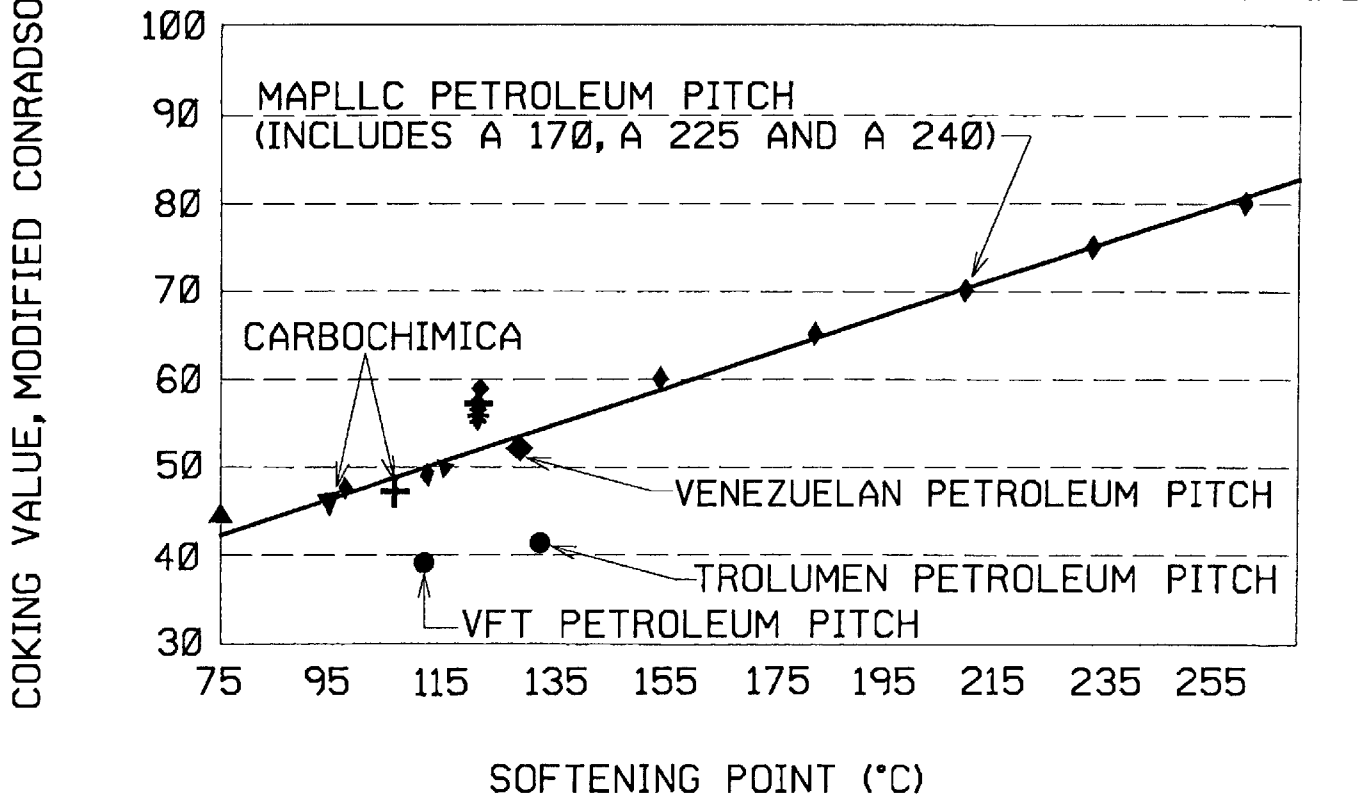
FIG. 3 (invention) is a graph of coking values v. softening point for petroleum pitch (prior art) with additional data points for softened pitches of the invention.

In these examples we took various commercially available, high softening pitch samples which had already been treated (with heat in a WFE) to produce specialty pitches with coking values of 60 wt % and above. These materials were diluted with various solvents. The data are reported in Table II, below, and in FIG. 3, which graphically reports the Table II data on the FIG. 1 data (for petroleum pitch).

TABLE II

Relationships between Softening Point versus Coking Value for High Softening Point/Cut-back Pitch

| Pitch | Cut-back Oil | Softening Point, Mettler | Coking Value |
|---|---|---|---|
| Aerocarb 60 | Heavy Cycle Oil | 121.7 | 55 |
| Aerocarb 80 | Heavy Cycle Oil | 123.5 | 58.9 |
| Aerocarb 60 | PVO | 121.0 | 55.0 |
| Aerocarb 60 | 2-Methylnaphthalene | 122.0 | 58.8 |
| Aerocarb 60 | PVO, IBP-650 Fraction | 120.3 | 57.1 |
| Aerocarb 60 | Dowtherm A | 124.0 | 58.5 |
| Aerocarb 60 | Dowtherm G | 122.0 | 55.9 |
| Aerocarb 60 | Dowtherm RP | 120.5 | 55.9 |
| Aerocarb 60 | Dowtherm Aromatic Eutectic Blend | 120.6 | 58.1 |

To make a "green" pitch for use in Canada or other environmentally sensitive areas, exclude the PVO, IBP-650° F. fraction and 2-methylnaphthalene. In comparison with coal tar pitch, A240 is already "green". However, the distillation process used to make the high softening point/coking value pitch removes more of the PAHs by distillation.

In the case where this concept is applied to coal tar pitch, reduction of PAHs will occur as well and replacement of the "bad" PAHs with other petroleum based compounds should improve the coal tar pitch from the environmental standpoint.

DISCUSSION

The process for making high coking value pitches of the invention provides a way to produce pitch with a desired softening point and a higher coking value than that exhibited by a prior art pitch with the same softening point. This processing of petroleum pitch permits it to be used as a complete or partial replacement for the valuable and dwindling supply of coal tar pitch. It also permits petroleum pitch to be used in many areas where the toxicity of coal tar pitch cannot be tolerated.

The process can be used to upgrade low quality pitches, in terms of coking value, such as Trolumen, which is believed to be made by an oxidative heat treatment process.

Regardless of the pitch used (coal tar, petroleum pitch by thermal processing, petroleum pitch by oxidative/thermal processing), it is preferred if the starting material has a softening point above about 110° C. This ensures that the fractionator or WFE or other processing equipment does not have to deal with undue amounts of lighter material.

The peak pitch will generally be treated sufficiently to increase the softening point by at least 20° C., and preferably by at least 40 or 50° C.

Thus the key variable for analyzing where to start and stop is softening point, rather than coking value. This is because pitches with similar softening points can have vastly different coking values, e.g., Trolumen v. coal tar pitch. Rather than specify an arbitrary minimum coking value, it is more useful to specify a minimum softening point for pitches which are susceptible to upgrading via peak processing and solvent softening. The process of the present invention does not do much good when the pitch is overwhelmed with large amounts of light material (softening point). Hence the interest in upgrading high softening point pitches.

MODIFICATIONS

Specific compositions, methods, or embodiments discussed are intended to be only illustrative of the invention disclosed by this specification. Variations on these compositions, methods, or embodiments are readily apparent to a person of skill in the art based upon the teachings of this specification and are therefore intended to be included as part of the invention disclosed herein.

Reference to documents made in the specification is intended to result in such patents or literature being expressly incorporated herein by reference including any patents or other literature references cited within such documents.

We claim:

1. A petroleum pitch having an increased coking value relative to Mettler softening point prepared by:

a. distilling or thermally processing an initial petroleum pitch having an initial coking value above 50 wt % and an initial softening point to produce a high coking value and high softening point petroleum pitch having a coking value of at least 60 wt % and at least 10% higher than said initial coking value and an increased softening point, and b. softening said high coking value petroleum pitch with a liquid hydrocarbon cutter oil to produce a processed petroleum pitch having an increased coking value relative to said initial coking value.

2. The pitch of claim 1 wherein said cutter oil is selected from the group of 2-Methyl-naphthalene and an aromatic blend.

3. The pitch of claim 1 wherein said high coking value is within the range of 60 wt % to 80 wt % and the high coking value pitch is softened by blending with an aromatic cutback solvent to produce a pitch with a coking value above 55 wt % and a softening point below 130 ° C.

4. The pitch of claim 1 wherein said high softening point pitch has an initial boiling point and a 10% boiling point and said liquid hydrocarbon cutter oil has a 90% boiling point and an end boiling point and wherein there is a gap between at least one of said 90% boiling point and said end point of said oil and at least one of said initial boiling point and said 10% boiling point of said pitch.

5. The pitch of claim 1 wherein said high softening point pitch has an initial boiling point and wherein said oil has an end boiling point which is lower than said initial boiling point of said high softening point pitch.

* * * * *